United States Patent [19]

Lenhard et al.

[11] 3,989,648

[45] Nov. 2, 1976

[54] DYE COATED CARRIER WITH TONER

[75] Inventors: Myron James Lenhard; Joseph Mammino, both of Penfield, N.Y.

[73] Assignee: Xerox Corporation, Stamford, Conn.

[22] Filed: Dec. 17, 1973

[21] Appl. No.: 425,438

Related U.S. Application Data

[62] Division of Ser. No. 218,014, Jan. 14, 1972, abandoned.

[52] U.S. Cl. ..... 252/62.1 P; 96/1 SD; 428/403

[51] Int. Cl.[2] ..... G03G 9/02

[58] Field of Search..... 252/62.1; 96/1 SD; 117/100 B, 100 M, 100 S, 17.5; 428/403

[56] References Cited

UNITED STATES PATENTS

| | | | |
|---|---|---|---|
| 3,094,429 | 6/1963 | Howell | 252/62.1 X |
| 3,609,532 | 9/1971 | Van Kirk et al. | 252/62.52 X |
| 3,718,594 | 2/1973 | Miller | 252/62.1 |
| 3,749,670 | 7/1973 | Ormsbee et al. | 252/62.1 |

FOREIGN PATENTS OR APPLICATIONS

| | | | |
|---|---|---|---|
| 572,459 | 3/1959 | Canada | 252/62.1 |
| 7,002,045 | 8/1970 | Netherlands | 252/62.1 |
| 1,183,762 | 3/1970 | United Kingdom | 252/62.1 |

*Primary Examiner*—Roland E. Martin, Jr.

[57] ABSTRACT

A carrier for electrostatographic developers comprising carrier particles comprising metals, metal alloys, metal compounds and mixtures thereof treated with a strongly adhering adsorbable organic dye. This carrier is used with toner particles to develop electrostatic latent images.

12 Claims, No Drawings

DYE COATED CARRIER WITH TONER

This is a division of application Ser. No. 218,014 filed Jan. 14, 1972, now abandoned.

BACKGROUND OF THE INVENTION

This invention relates in general to imaging systems and, more particularly, to improved developing materials, their manufacture and use.

The formation and development of images on the surface of photoconductive materials by electrostatic means is well known. The basic electrostatographic imaging process, as taught by C.F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting electrostatic latent image by depositing on the image a finely divided electropscopic material referred to in the art as "toner". The toner will normally be attracted to those areas of the layer which retain a charge, thereby forming a toner image corresponding to the electrostatic latent image. This powder image may then be transferred to a support surface such as paper. The transferred image may subsequently be permanently affixed to the support surface as by heat. Instead of latent image formation by uniformly charging the photoconductive layer and then exposing the layer to a light and shadow image, one may form the latent image by directly charging the layer in image configuration The powder image may be fixed to the photoconductive layer if elimination of the powder image transfer step is desired. Other suitable fixing means such as solvent or overcoating treatment may be substituted for the foregoing heat fixing step.

Many methods are known for applying the electroscopic particles to the electrostatic latent image to be developed. One development method, as disclosed by E.N. Wise in U.S. Pat. No. 2,618,552 is known as "cascade" development. In this method, a developer material comprising relatively large carrier particles having finely divided toner particles electrostatically clinging to the surface of the carrier particles is conveyed to and rolled or cascaded across the electrostatic latent image bearing surface. The composition of the toner particles is so chosen as to have a triboelectric polarity opposite that of carrier particles. As the mixture cascades or rolls across the image bearing surface, the toner particles are electrostatically deposited and secured to the charged portion of the latent image and are not deposited on the uncharged or background portions of the image. Most of the toner particles accidentally deposited in the background are removed by the rolling carrier, due apparently, to the greater electrostatic attraction between the toner and the carrier than between the toner and the discharged background. The carrier particles and unused toner particles are then recycled. This technique is extremely good for the development of line copy images. The cascade development process is the most widely used commercial xerographic development techique. A general purpose office copying machine incorporating this technique is described in U.S. Pat. No. 3,099,943.

Another technique for developing electrostatic images is the "magnetic brush" process as disclosed, for example, in U.S. Pat. No. 2,874,063. In this method, a developer material containing toner and magnetic carrier particles is carried by a magnet. The magnetic field of the magnet causes alignment of the magnetic carriers in a brushlike configuration. This magnetic brush is engaged with an electrostatic image bearing surface and the toner particles are drawn from the brush to the electrostatic image by electrostatic attraction.

While ordinarily capable of producing good quality images, conventional developing materials suffer serious deficiencies in certain areas. The developing materials must flow freely to facilitate accurate metering and even distribution during the development and developer recycling phases of the electrostatographic process. Some developer material though possessing desirable properties such as proper triboelectric characteristics, are unsuitable because they tend to cake, bridge and agglomerate during handling and storage. Adherence of carrier particles to reusable electrostatographic imaging surface causes the formation of undesirable scratches on the imaging surfaces during image transfer and surface cleaning steps. The coatings of most carrier particles deteriorate rapily when employed in continuous processes which require the recycling of carrier particles by bucket or screw conveyors partially submerged in the developer supply. Deterioration occurs when portions of or the entire coating separates from the carrier core. The separation may be in the form of chips, flakes or entire layers and is primarily caused by fragile, poorly adhering coating materials which fail upon impact and abrasive contact with machine parts and other carrier particles. Carriers having coatings which tend to chip and otherwise separate from the carrier core must be frequently replaced thereby increasing expense and consuming time. Print deletion and poor print quality occur when carriers having damaged coatings are not replaced. Fines and grit formed from carrier disintegration tend to drift and form unwanted deposits on critical machine parts. Many carrier coatings having high compressive and tensile strength either do not adhere well to the carrier core or do not possess the desired triboelectric characteristics. The triboelectric and flow characteristics of many carriers are adversely affected when relative humidity is high. For example, the triboelectric values of some carrier coatings fluctuate with changes in relative humidity and are not desirable for employment in electrostatographic systems, particularly in automatic machines which require carriers having stable and predictable triboelectric values. Thus, there is a continuing need for a better system for developing electrostatic latent images.

SUMMARY OF THE INVENTION

It is, therefore, an object of this invention to provide developing materials which overcome the above noted deficiencies.

It is another object of this invention to provide developing materials which flow freely.

It is a further object of this invention to provide carrier coating materials which tenaciously adhere to carrier cores.

It is still a further object of this invention to provide carrier coatings which are resistant to chipping, flaking and the like.

It is another object of this invention to provide developers having physical and chemical properties superior to those of known developer materials.

The above objects and others are accomplished, generally speaking, by providing dye treated metallic carrier particles having improved properties. In general, the carrier treating materials of this invention are organic dyes which are adsorbable on the outer surface of metallic carrier particles. The adsorbed organic dye adheres to the carrier surface through a mechanism which is not clearly understood. The adsorbed organic dye may consist of monolayers, multilayers, concentrations of dye material in tiny capillaries of the adsorbent carrier surface or a combination of these forms. The dye may be physically and/or chemically adsorbent to the surface of the metal carriers.

Any suitable dye which is adsorbable on a metal surface may be employed. Typical adsorbable dyes include: azo dyes such as Oil Red (C.I. 258), Luxol Fast Blue AR, Solvent Blue 37 (C.I. 13390), Sudan Red BV (C.I. 1125), and Sudan Orange RA New (C.I. 12055); axoic dyes such as Napthol As-LT (C.I. 37540) and Fast Black LB Base (C.I. 37205); acridine dyes such as Flaveosine (C.I. 46060) and Acridine Orange R (C.I. 46055); azine dyes such as Safranane T (C.I. 50240) and Rhoduline Violet (C.I. 50215); ketone amine dyes such as Helindon Yellow (C.I. 5600) and Helindon Brown CR (C.I. 56045); methine dyes such as Astro Violet FF extra (C.I. 48080) and Astro Violet FN extra (C.I. 48075); nitro dyes such as Picric Acid (C.I. 10305) and Brilliant Yellow (C.I. 10317); nitroso dyes such as Dioxide L (C.I. 10015) and Gambine R (C.I. 10010); oxazine dyes such as Ultracyanine (C.I. 51130) and Meta Celestine Blue (C.I. 51170); quinoline dyes such as Supra Light Yellow GGL (C.I. 47020) and Quinoline Yellow (C.I. 47005); thiazine dyes such as Indochromogen S (C.I. 52050) and Methylene Blue A (C.I. 52015); thiazole dyes such as Primuline (C.I. 49000) and Thioflavin (C.I. 49005); triarylmethane dyes such as Wool Fast Violet FB (C.I. 44500) and Wool Fast Blue FGL (C.I. 44505); dioxazine dyes such as Sirius Supra Blue FFB (C.I. 51305) and Sirius Light Blue FFGL (C.I. 51320); xanthene dyes such as Fanal Red 6BM (C.I. 45175) and Spirit Fast Violet K (C.I. 45185); sulfur dyes such as Sulphur Brown 42 (C.I. 53030) and Sulphur Brown 35 (C.I. 58250); and dinitroanthrachrysone disulfonic acid (C.I. 58510); indigoid dyes such as Soluble Vat Blue 2B (C.I. 73066) and Indigo Yellow 3G (C.I. 73100); phthalocyanine dyes such as Sirius Supra Green FFGL (C.I. 74320) and Solvent Blue 24 (C.I. 74380), and mixtures thereof. Preferably, the carrier particles are treated with a solution of the adsorbable dye because greater control over uniform treatment of the carrier particles is achieved. Satisfactory results are achieved with solutions containing from about 0.5 to about 25 parts by weight of dissolved adsorbable dye. Surprisingly, no free dye material is observed with carrier particles treated with solutions containing a dye concentration as high as 25 parts by weight dye. Generally, the quantity of dye adsorbed on the carrier surfaces decreases per unit time as the concentration of dissolved dye decreases. Various additives may be added to the dye solution to promote adsorption of the dye onto the carrier surface. For example, surface active agents such as toluene, methyl ethyl ketone and methanol; surface tension reducing agents such as ethoxylated nonyl phenols, for example, Triton X-100, available from Rohm & Haas Company, neutral detergents such as Sulframin DR, available from Ultra Chemical Works, and dioxtyl sodium sulfosuccinate, for example, Aerosol OT, available from American Cyanamid Company, as well as core oxidation inhibitors such as amonium thiocyanate and cerric sulfate may be employed in the dye solution. The rate of adsorption of the dye is often improved by imparting vibratory energy to the dye solution. Satisfactory results are achieved with vibratory frequencies of from about 1700 to about 2100 cycles per minute. After the carrier particles are treated with the dye solution, the solvent and excess dye may be removed by any suitable technique such as by exposure to infrared heat lamps, oven drying, drying in ambient air, forced air drying and the like. The amount of dye adsorbed by a carrier depends upon numerous factors such as the specific combination of materials employed, the length of contact time, the temperature of the solution, the presence of additives (e.g. surface active agents) the use of agitation, and other conditions. The carrier need not be treated to the extent that maximum dye adsorption is achieved. However, it is desirable to remove all unadsorbed dye from the treated carrier mixture. Removal of excess unadsorbed dye, if any, may be effected by any suitable process such as by washing with a solvent, air separation, or screening. Removal of unadsorbed dye is preferred to avoid undesirable contamination of reusable photoreceptor surfaces and variation in print quality as the unadsorbed dye material is depleted from a reusable developer. Sufficient dye is adsorbed on the carrier surface of this invention when a carrier core is merely immersed in a solution of dye having a concentration of about one half percent of weight, based on the weight of the solvent, at 70° F. until completely wetted and thereafter removed and dried. Complete wetting occurs when the observed color change of the carrier surface stabilizes. Carrier surfaces comprising aluminum, nickel, zinc, iron and alloys thereof treated with azoic, azine, ketone, phthalocyanine dyes or mixtures thereof are preferred because of the marked effect on the triboelectric value of the carrier per given quantity of dye. Optimum results are achieved with porous carrier surfaces treated with adsorbed dyes because of the improved adherence and greater life of the adsorbed dye.

Any suitable carrier particle containing a metal, metal compound, metal alloy or mixture of metals which will adsorb organic dyes may be employed. Typical metals include: aluminium, cobalt, copper, iron, lead, magnesium, nickel, tin, zinc, gold, silver, antimony, beryllium, bismuth, cadmium, calcium, manganese, selenium, titanium, tungsten, vanadium zirconium and mixtures and alloys thereof. Many metallic compounds will also adsorb dyes. Typical metallic compounds include metal oxides such as aluminium oxide, oxidized steel, nickel oxide, and zirconium oxide; refractory oxides such as titanium oxide and magnesium oxide; refractory nitrides such as vanadium nitride and chromium nitride; carbides such as tungsten carbide and silica carbide and the like. Typical combinations of metal containing carrier and an adsorbable dye include: aluminium or steel particles having an oxidized outer surface treated with Alizarin Cyanin RR, Alizarin Green S, Nigrosine 2 Y and Naphthalene Blue RS; iron particles and Oil Red or Luxol Fast Blue MDSN; nickel and Dupont Oil Red or Luxol Fast Blue AR; zirconium and Luxol Fast Blue AR or Dupont Oil Red and the like.

The carries of this invention may be treated with an adsorbable dye by any suitable means. Generally, the carriers are treated with an adsorbable dye dissolved in a solvent. The carrier may be treated with the dye solution by spraying, dipping, or any other suitable technique. An ultimate treated carrier particle diameter between about 1 and about 1000 microns performs satisfactorily. For a magnetic brush development process, the treated carrier particles should have a diameter between about 1 to about 250 microns. In addition, carrier particles for use in magnetic brush development systems should be attractable by a magnet. For cascade development processes, the treated carrier particles should have a diameter between about 30 microns and about 1000 microns. Further, carrier particles for cascade development should possess sufficient density and inertia to avoid adherance to electrostatic images during development. Adherence of carrier beads to a reusable electrostatographic imaging surface is undesirable because of the formation of deep scratches on the imaging surface during the image transfer and drum cleaning steps, particularly when cleaning is accomplished by a web cleaner such as the web disclosed by W.P. Graff, Jr. et al. in U.S. Pat. No. 3,186,838.

The carrier particles may have a smooth, porous or rough surface and may have a spherical, regular, or irregular configuration. For cascade development processes, the carrier particles are preferably selected to have a spherical shape for maximum control over copy quality including control over image density, image definition, and reduction of background deposits.

Any suitable pigmented or dyed electroscopic toner material may be employed with the treated carriers of this invention. Typical toner materials include: gum, copal, gum sandarac, rosin, cumaroneindene resin, asphaltum, gilsonite, phenolformaldehyde resins, rosin modified phenolformaldehyde resins, methacrylate resins, polystyrene resins, polypropylene resins, epoxy resins, polyethylene resins and mixtures thereof. The particular toner material to be employed obviously depends upon the separation of the toner from treated carrier beads in the triboelectric series. Among the patents describing the electroscopic toner compositions are U.S. Pat. No. 2,659,670 to Copley; U.S. Pat. No. 2,753,308 to Landrigan; U.S. Pat. No. 3,079,342 to Insalaco; U.S. Pat. Re. No. 25,136 to Carlson; and U.S. Pat. No. 2,788,288 to Rheinfrank et al. These toners generally have an average particle diameter between about 1 and about 30 microns.

Any treated carrier particle may be employed in combination with any suitable toner particle by selecting an adsorbable dye material which will permit the carrier particles to acquire a charge having an opposite polarity to that of the toner particles when brought in close contact with the toner particles so that the toner particles adhere to and surround the carrier particles. When a positive reproduction of an electrostatic image is desired, the adsorbable dye is selected so that the toner particles acquire a charge having a polarity opposite to that of electrostatic latent image. Alternatively, if a reversal reproduction of the electrostatic image is desired, the adsorbable organic dye is selected so that the toner particles acquire a charge having the same polarity as that of the electrostatic image. Thus, the adsorbable dye for the carrier particles is selected in accordance with its triboelectric properties in respect to the electroscopic toner so that when mixed or brought into mutual contact, either the adsorbable dye component or electroscopic toner component of the developer is charged positively if the other component is below the first component in the triboelectric series and negatively if the other component is above the first component in the triboelectric series. By proper selection of materials in accordance with their triboelectric effects, the polarities of their charge when mixed are such that the electroscopic toner particles adhere to and are coated on the treated surfaces of carrier particles and also adhere to that portion of the electrostatic image bearing surface having a greater attraction for the toner than the carrier particles. Generally speaking, satisfactory results are obtained when about 1 part by weight of toner is used with about 10 to about 200 parts by weight of treated carrier.

Surprisingly, the adsorbed dyes of this invention adhere extremely well to carrier particle surfaces without the aid of a resin binder. Thus, the problems encountered with resinous carrier coatings such as carrier particle agglomeration during a subsequent to coating, coating deterioration through chipping and flaking, and print deletion due to loose carrier coating particles are eliminated with the carriers of this invention. In addition, carriers treated with adsorbed organic dyes possess greater resistance to fluctuations in triboelectric properties for greater periods of time.

DESCRIPTION OF THE PREFERRED EMBODIMENTS

The following examples further define, describe and compare exemplary methods of preparing the development system components of the present invention and of utilizing them in a development process. Parts and percentages are by weight unless otherwise indicated. The examples, other than the control examples, are also intended to illustrate the various preferred embodiments of the present invention.

EXAMPLE I

About 1000 grams of iron filings having an average particle size of about 100 microns is dispersed in a dye solution consisting of about 1 gram of Oil Red dye (available from E.I. duPont de Nemours & Company, Incorporated) dissolved in about 300 milliliters of acetone. After the resulting slurry is stirred for about 5 minutes, the excess dye solution is removed by decantation. The treated iron filings are then loosely scattered in a shallow pan and dried in an oven heated to about 140° F. About 97 grams of the dried iron particles are mixed with about 3 grams of toner particles comprising a carbon black pigmented blend of polystyrene and polybutylmethacrylate having a particle size of about 14 microns to form a magnetic brush developer. The resulting magnetic developer is then formed into a magnetic brush as described in U.S. Pat. No. 2,874,063 and employed to develop a positively charged electrostatic latent image on a selenium photoreceptor surface. The deposited toner image is electrostatically transferred to a paper sheet. The transferred image is dense, very sharp and very little background discoloration is observed.

EXAMPLE II

The process described in Example I is repeated with about 1 gram of Luxol Fast Blue AR dye (available from E.I. duPont de Nemours & Company, Incorporated) substituted for the Oil Red dye. The toner particles deposit in the discharged areas of the positively charged electrostatic latent image bearing selenium photoreceptor surface to form a dense, sharp, reversal image.

EXAMPLE III

The process described in Example I is repeated with untreated iron filings substituted for the treated iron filings. The resulting toner image is characterized by extremely heavy background discoloration caused by toner deposits in the charged as well as discharged areas of the selenium photoreceptor surface. This control example clearly illustrates that the same unsuitable metallic carrier may easily be adapted to form either positive or reversal toner images by employing the simple dye treatment of this invention.

EXAMPLE IV

The developer described in Example III is formed into a magnetic brush as described in U.S. Pat. No. 2,874,063 and employed to develop a negatively charged electrostatic latent image bearing zinc oxide binder plate surface. The toner particles deposit in the charged areas to form clearly defined direct images devoid of visible background toner deposits.

EXAMPLE V

The process described in Example IV is repeated with the developer employed in Example I. The toner particles deposit in the discharged areas to form dense reversal toner images.

EXAMPLE VI

The process described in Example IV is repeated with untreated iron filings substituted for the dye treated iron filings. The resulting toner image is characterized by poorly defined low density direct and reversal images. Thus, the results described in Examples IV, V and VI clearly demonstrate the rapid conversion of normally unsuitable or marginal carrier material to excellent carriers by treating the carrier materials with an adsorbable organic dye.

EXAMPLE VII

About 450 grams of zirconium oxide particles having an average particle size of about 600 microns is dispersed in a dye solution consisting of Safranine T dissolved in about 400 milliliters of methyl ethyl ketone. After the resulting slurry is stirred for about 5 minutes, the excess dye solution is removed by decantation and the treated particles are dried. About 150 grams of the dried treated carrier particles are mixed with about 1 gram of carbon black pigmented styrenebutylmethacrylate copolymer toner paticles having a particle size of about 10–15 microns to form a developer composition. The developer composition is employed in a Xerox Model D electrostatic copying machine to develop a reversal charged electrostatic latent image on a selenium photoreceptor surface. The deposited toner image is sharp and clear with very little background discoloration.

EXAMPLE VIII

About 450 grams of nickel particles having an average particle size of about 450 microns is dispersed in a dye solution consisting of Monastrol Green GNS dissolved in about 450 milliliters of toluene. After the resulting slurry is stirred for about 5 minutes, the excess dye solution is removed by decantation and the treated particles are dried. About 100 grams of the dried treated carrier particles are mixed with about 1 gram of carbon black pigmented styrene-butyl methacrylate copolymer toner particles having a particle size of about 16 microns to form a developer composition. The developer composition is employed in a Xerox Model D electrostatic copying machine to develop a positively charged electrostatic latent image on a selenium photoreceptor surface. The deposited toner image is dense, sharp and clear with no visible discoloration due to background toner deposits.

EXAMPLE IX

About 450 grams of aluminium shot particles having an average particle size of about 250 microns is dispersed in a dye solution consisting of Monastrol Blue RFS dissolved in about 400 milliliters of toluene. After the resulting slurry is stirred for about 5 minutes, the excess dye solution is removed by decantation and the treated particles are dried. About 200 grams of the dried treated carrier particles are mixed with about 1 gram of carbon black pigmented styrenebutylmethacrylate copolymer toner particles having a particle size of about 15 microns to form a developer composition. The developer composition is employed in a Xerox Model D electrostatic copying machine to develop a positively charged electrostatic latent image on a selenium photoreceptor surface. The deposited toner image is sharp, clear and dense with very little discoloration due to background toner deposits.

EXAMPLE X

About 450 grams of aluminium-zinc shot particles having an average particle size of about 250 microns is dispersed in a dye solution consisting of Monastrol Blue BXS dissolved in about 450 milliliters of toluene. After the resulting slurry is stirred for about 5 minutes, the excess dye solution is removed by decantation and the treated particles are dried. About 150 grams of the dried treated carrier particles are mixed with about 1 gram of toner particles described in Example IX to form a developer composition. The developer composition is employed in a flat plate type electrostatic copying machine to develop a positively charged electrostatic latent image on a selenium photoreceptor surface. The deposited toner image is clear, sharp and dense with a very slight coloration of background areas.

EXAMPLE XI

About 300 grams of iron shot particles having an average particle size of about 100 microns is dispersed in a dye solution consisting of Monastrol Blue GS dissolved in about 450 milliliters of toluene. After the resulting slurry is stirred for about 5 minutes, the excess dye solution is removed by decantation and the treated particles are dried. About 100 grams of the dried treated carrier particles are mixed with about 1 gram of toner particles described in Example IX to form a developer composition. The developer composition is employed in a flat plate type electrostatic copying machine to develop a positively charged electrostatic latent image on a selenium photoreceptor surface. The deposited toner image is sharp, clear and dense with a slight coloration of the background areas.

EXAMPLE XII

A control sample containing about one part colored toner particles having an average particle size of about 10 to about 20 microns and about 99 parts coated carrier particles available in the Xerox 813 Developer sold by the Xerox Corporation is cascaded across a reusable electrostatic image bearing selenium surface. The resulting developed toner image is electrostatically transferred to a sheet of paper whereon it is fused by heat. After the copying process is repeated 2000 times, the developer mix is examined for the presence of carrier coating chips and flakes. Numerous carrier coating chips and flakes are found in the developer mix.

EXAMPLE XIII

The process of Example XII is repeated with the carrier described in Example IX substituted for the Xerox 813 carrier. An examination of the developer mix after test termination reveals substantially no loose dye material abraded from the carrier surfaces.

EXAMPLE XIV

The process of Example XII is repeated with the carrier described in Example X substituted for the Xerox 813 carrier. An examination of the developer mix after test termination reveals substantially no loose dye material abraded from the carrier surfaces.

EXAMPLE XV

The process of Example XII is repeated with the carrier described in Example XI substituted for the Xerox 813 carrier. An examination of the developer mix after test termination reveals substantially no loose dye material abraded from the carrier surfaces.

EXAMPLE XVI

The process of Example XII is repeated with the carrier described in Example VIII substituted for the Xerox 813 carrier. An examination of the developer mix after test termination reveals substantially no loose dye material abraded from the carrier surfaces.

EXAMPLE XVII

The process of Example XII is repeated with the carrier described in Example VII substituted for the Xerox 813 carrier. An examination of the developer mix after test termination reveals substantially no loose dye material abraded from the carrier surfaces.

EXAMPLE XVIII

The process of Example XII is repeated with the carrier described in Example II substituted for the Xerox 813 carrier. An examination of the developer mix after test termination reveals substantially no loose dye material from the carrier surfaces.

Although specific materials and conditions are set forth in the above exemplary processes in making and using the treated carriers of this invention, these are merely intended as illustrations of the present invention. Various other toners, organic dyes, carriers, additives, substitutes and processes such as those listed above may be substituted for those in the Examples with similar results.

Other modifications of the present invention will occur to those skilled in the art upon a reading of the present disclosure. These are intended to be included within the scope of this invention.

What is claimed is:

1. An electrostatographic developer mixture comprising finely divided toner particles electrostatically clinging to the surface of carrier particles having an average particle diameter from between about 1 micron and about 1,000 microns, said carrier particles comprising solid particles selected from the group consisting of metals, metal alloys, metal compounds, and mixtures thereof coated with an adsorbed layer of an organic dye, which layer of dye ennables said carrier particles to assume an electrostatic charge opposite to that on said toner particles.

2. An electrostatographic developer mixture according to claim 1 wherein said solid particles comprise iron, and said organic dye is selected from the group consisting of azo dyes, azine dyes, azoic dyes, ketone dyes, phthalocyanine dyes, and mixtures thereof.

3. An electrostatographic developer mixture according to claim 1 wherein said solid particles comprise nickel, and said organic dye is selected from the group consisting of azo dyes, azine dyes, azoic dyes, ketone dyes, phthalocyanine dyes, and mixtures thereof.

4. An electrostatographic developer mixture comprising finely-divided toner particles electrostatically clinging to the surface of dye-treated carrier particles, said carrier particles comprising metallic carrier particles coated with an adsorbed layer of an organic dye, which layer of dye ennables carrier particles to assume an electrostatic charge opposite to that on said toner particles, said carrier particles having an average particle diameter from between about 1 micron and about 1,000 microns and selected from the group consisting of metals, metal alloys, metal compounds, and mixtures thereof, said dye having been selected in accordance with its triboelectric properties with respect to said toner particles so that when said toner particles are mixed or brought into contact with said treated carrier particles, either said treated carrier particles or said toner particles are charged positively if said toner particles are below said treated carrier particles in a triboelectric series and negatively if said toner particles are above said treated carrier particles in said triboelectric series.

5. An electrostatographic developer mixture according to claim 4 wherein said metallic carrier particles are selected from aluminum, cobalt, copper, iron, lead, magnesium, nickel, tin, zinc, gold, silver, antimony, beryllium, bismuth, cadmium, calcium, manganese, selenium, titanium, tungsten, vanadium, zirconium, metal oxides, refractory oxides, refractory nitrides, carbides and mixtures thereof.

6. An electrostatographic developer mixture according to claim 4 wherein said organic dye is selected from the group consisting of azo dyes, azoic dyes, azine dyes, ketone dyes, phthalocyanine dyes, and mixtures thereof.

7. An electrostatographic developer mixture according to claim 4 wherein said organic dye comprises Oil Red dye and said metallic carrier particles comprise iron filings.

8. An electrostatographic developer mixture comprising finely-divided toner particles electrostatically clinging to the surface of larger, dye-treated carrier particles having an average particle diameter from between about 1 micron and about 1,000 microns, said carrier particles comprising solid metallic particles selected from the group consisting of metals, metal alloys, metal compounds, and mixtures thereof coated with an adsorbed layer of an organic dye, which layer of dye ennables said carrier particles to assume an electrostatic charge opposite to that on said toner particles wherein said dye-treated carrier particles are characterized as being resistant to fluctuations in triboelectric properties.

9. An electrostatographic developer mixture comprising finely-divided toner particles electrostatically clinging to the surface of dye-treated carrier particles, said dye-treated carrier particles comprising metallic carrier particles coated with an adsorbed layer of an organic dye and wherein said dye-treated carrier particles are characterized as being resistant to fluctuations in triboelectric properties, said carrier particles having an average particle diameter from between about 1 micron and about 1,000 microns and having been selected from the group consisting of metals, metal alloys, metal compounds, and mixtures thereof, said dye having been selected in accordance with its thereof, said dye having been selected in accordance with its triboelectric properties with respect to said toner particles so that when said toner particles are mixed or brought into contact with said treated carrier particles either said treated carrier particles or said toner particles are charged positively if said toner particles are below said treated carrier particles in a triboelectric series and negatively if said toner particles are above said treated carrier particles in said triboelectric series.

10. An electrostatographic developer mixture according to claim 9 wherein said metallic carrier particles are selected from aluminium, cobalt, copper, iron, lead, magnesium, nickel, tin, zinc, gold, silver, antimony, berryllium, bismuth, cadmium, calcium, manganese, selenium, titantium, tungsten, vanadium, zirconium, metal oxides, refractory nitrides, carbides and mixtures thereof.

11. An electrostatographic developer mixture according to claim 9 wherein said organic dye is selected from the group consisting of azo dyes, azoic dyes, azine dyes, ketone dyes, phthalocyanine dyes and mixtures thereof.

12. An electrostatographic developer mixture according to claim 9 wherein said organic dye comprises Oil Red dye and said metallic carrier particles comprise iron filings.

* * * * *